US009759455B2

(12) United States Patent
Yamada

(10) Patent No.: US 9,759,455 B2
(45) Date of Patent: Sep. 12, 2017

(54) CRYOGENIC REFRIGERATOR

(71) Applicant: Sumitomo Heavy Industries, Ltd., Tokyo (JP)

(72) Inventor: Koji Yamada, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 293 days.

(21) Appl. No.: 14/226,188

(22) Filed: Mar. 26, 2014

(65) Prior Publication Data

US 2014/0290277 A1 Oct. 2, 2014

(30) Foreign Application Priority Data

Mar. 28, 2013 (JP) ..... 2013-070464

(51) Int. Cl.

| | |
|---|---|
| ***F25B 9/00*** | (2006.01) |
| ***F25B 9/14*** | (2006.01) |
| *F25B 9/12* | (2006.01) |
| *F25B 9/06* | (2006.01) |

(52) U.S. Cl.

CPC ..... *F25B 9/14* (2013.01); *F17C 2227/0353* (2013.01); *F25B 9/06* (2013.01); *F25B 9/12* (2013.01)

(58) Field of Classification Search

CPC ..... F25B 9/14; F25B 9/06; F25B 9/12; F17C 2227/0353

USPC ..... 62/6

See application file for complete search history.

(56) References Cited

U.S. PATENT DOCUMENTS

| | | | | | |
|---|---|---|---|---|---|
| 4,388,809 | A * | 6/1983 | Sarcia | F25B 9/14 | 137/624.13 |
| 4,979,368 | A * | 12/1990 | Stetson | F25B 9/14 | 220/288 |
| 5,018,357 | A * | 5/1991 | Livingstone | F25B 9/14 | 60/520 |
| 5,361,588 | A * | 11/1994 | Asami | F25B 9/14 | 62/6 |
| 2005/0126187 | A1* | 6/2005 | Li | F25B 9/14 | 62/6 |
| 2009/0293505 | A1* | 12/2009 | Wang | F25B 9/14 | 62/51.1 |

FOREIGN PATENT DOCUMENTS

JP 2011-017457 A 1/2011

* cited by examiner

*Primary Examiner* — David Teitelbaum

(74) *Attorney, Agent, or Firm* — Michael Best & Friedrich LLP

(57) ABSTRACT

A cryogenic refrigerator includes a compressor which compresses a working gas, a housing which includes a space which the working gas compressed by the compressor flows into and flows from, a cylinder of which an end is connected to the housing and which includes an expansion space at the other end, and a displacer which permits flowing of the working gas into and from the expansion space via a working gas channel provided in an inner portion of the displacer while reciprocating in an inner portion of the cylinder. The working gas flows through a pipe which communicates with the space and the working gas channel.

2 Claims, 6 Drawing Sheets

CRYOGENIC REFRIGERATOR

INCORPORATION BY REFERENCE

Priority is claimed to Japanese Patent Application No. 2013-070464, filed Mar. 28, 2013, and the entire content of which is incorporated herein by reference.

BACKGROUND

Technical Field

The present invention relates to a cryogenic refrigerator including a displacer.

Description of the Related Art

As an example of a cryogenic refrigerator which generates an extremely low temperature, Gifford McMahon (GM) refrigerator has been known. In GM refrigerator, using a volume change of a space by a displacer reciprocating in a cylinder using a drive unit, a working gas supplied from a compressor is expanded in an expansion chamber, and thus, cooling is generated.

Accordingly, in the related art, the high pressure working gas generated by the compressor is introduced into the expansion chamber via the displacer, and the working gas, which is expanded in the expansion chamber, is required to be recirculated to the compressor via the displacer.

SUMMARY

According to an embodiment of the present invention, there is provided a cryogenic refrigerator including: a compressor which compresses a working gas; a housing which includes a space which the working gas compressed by the compressor flows into and flows from; a cylinder of which an end is connected to the housing and which includes an expansion space at the other end; and a displacer which permits flowing of the working gas into and from the expansion space via a working gas channel provided in an inner portion of the displacer while reciprocating in an inner portion of the cylinder. The working gas flows through a pipe which communicates with the space and the working gas channel.

DETAILED DESCRIPTION

In order to permit reciprocation of a displacer in a cylinder, it is necessary to provide a space of a certain extent at a high temperature side of the displacer. The space functions as a portion of a channel when a working gas supplied from a compressor is introduced to the displacer. However, since capacity of the space is changed according to driving of the displacer, the working gas in the space may be compressed. If compression heat is generated due to the compression, heat loss of the working gas occurs, and cooling efficiency of a cryogenic refrigerator may be decreased.

Accordingly, it is desirable to provide a cryogenic refrigerator having a high cooling efficiency.

According to the cryogenic refrigerator, cooling efficiency can be increased.

Next, embodiments of the present invention will be described with reference to the drawings.

Figure 1:
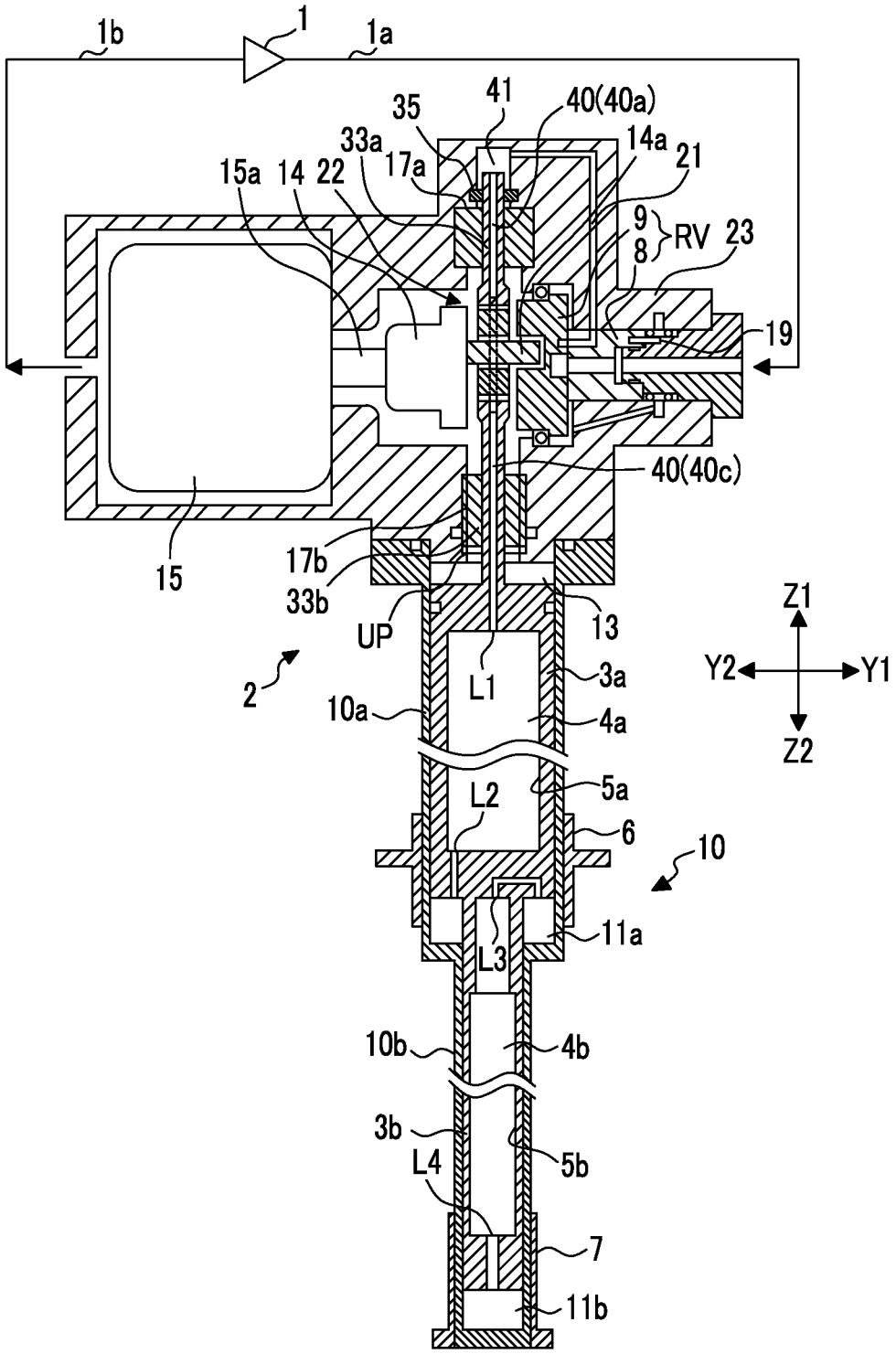
FIG. 1 is a cross-sectional view of Gifford McMahon (GM) refrigerator according to an embodiment of the present invention.

FIG. 1 is a cross-sectional view showing a cryogenic refrigerator according to an embodiment of the present invention. In the present embodiment, Gifford McMahon (GM) refrigerator will be described as an example of the cryogenic refrigerator. However, certain embodiments of the present invention can be widely applied to a cryogenic refrigerator including a displacer.

GM refrigerator according to the present embodiment includes a gas compressor 1 and a cold head 2. The cold head 2 includes a cylinder portion 10 and a housing 23.

The gas compressor 1 suctions a working gas from an intake port connected to a discharge pipe 1*b*, compresses the working gas, and thereafter, supplies the high pressure working gas to a supply pipe 1*a* connected to a discharge port. As the working gas, helium gas may be used. However, the working gas is not limited thereto.

In the present embodiment, a two-step type GM refrigerator will be described as an example. In the two-step type GM refrigerator, the cylinder portion 10 includes two cylinders such as a first step cylinder 10*a* and a second step cylinder 10*b*. A first step displacer 3*a* is inserted into an inner portion of the first step cylinder 10*a*. Moreover, a second step displacer 3*b* is inserted into an inner portion of the second step cylinder 10*b*.

The first step displacer 3*a* and the second step displacer 3*b* are connected to each other, and are configured so as to reciprocate in axial directions of cylinders in the inner portions of the cylinders 10*a* and 10*b*. Space portions 5*a* and 5*b* are formed in inner portions of the displacers 3*a* and 3*b*, respectively. Regenerator materials (Cold storage materials) are filled in the space portions 5*a* and 5*b*, and function as regenerators 4*a* and 4*b*. Moreover, since the working gas flows into and flows out from expansion chambers 11*a* and 11*b* described below while performing heat exchange with the regenerator materials, each of the regenerators 4*a* and 4*b* may be referred to as a working gas channel.

The first step displacer 3*a* positioned at the upper portion includes a drive shaft 33*b* which extends upward (Z1 direction). The drive shaft 33*b* configures a portion of a scotch yoke mechanism 22 described below.

Moreover, a gas channel L1 communicating with a scotch yoke pipe 40 described below is formed on a high temperature end side (Z1 direction side end) of the first step displacer 3*a*. In addition, a gas channel L2 communicating with the space portion 5*a* and the first step expansion chamber 11*a* is formed on a low temperature end side (Z2 direction side end) of the first step displacer 3*a*.

The first step expansion chamber 11*a* is formed on the low temperature side end (an end at a direction side shown by an arrow Z2 in FIG. 1) of the first step cylinder 10*a*. Moreover, an upper chamber 13 is formed on the high temperature side end (an end at a direction side shown by an arrow Z1 in FIG. 1) of the first step cylinder 10*a*.

The second step expansion chamber 11*b* is formed on the low temperature side end (the end at the direction side shown by the arrow Z2 in FIG. 1) in the second step cylinder 10*b*.

The second step displacer 3*b* is mounted on a lower portion of the first step displacer 3*a* by a connection mechanism (not shown). A gas channel L3 communicating with the first step expansion chamber 11*a* and the space portion 5*b* is formed on the high temperature side end (the end at the direction side shown by the arrow Z1 in FIG. 1) of the second step displacer 3*b*. In addition, a gas channel L4 communicating with the space portion 5*b* and the second step expansion chamber 11*b* is formed on the low temperature side end (the end at the direction side shown by the arrow Z2 in FIG. 1) of the second step displacer 3*b*.

A first step cooling stage 6 is disposed at a position facing the first step expansion chamber 11*a* on an outer circumferential surface of the first step cylinder 10*a*. Moreover, a second step cooling stage 7 is disposed at a position facing the second step expansion chamber 11*b* on an outer circumferential surface of the second step cylinder 10*b*.

The first step displacer 3*a* and the second step displacer 3*b* move in up and down directions (the directions of arrows Z1 and Z2) in the drawings in the first step cylinder 10*a* and the second step cylinder 10*b* by the scotch yoke mechanism 22.

Figure 2:
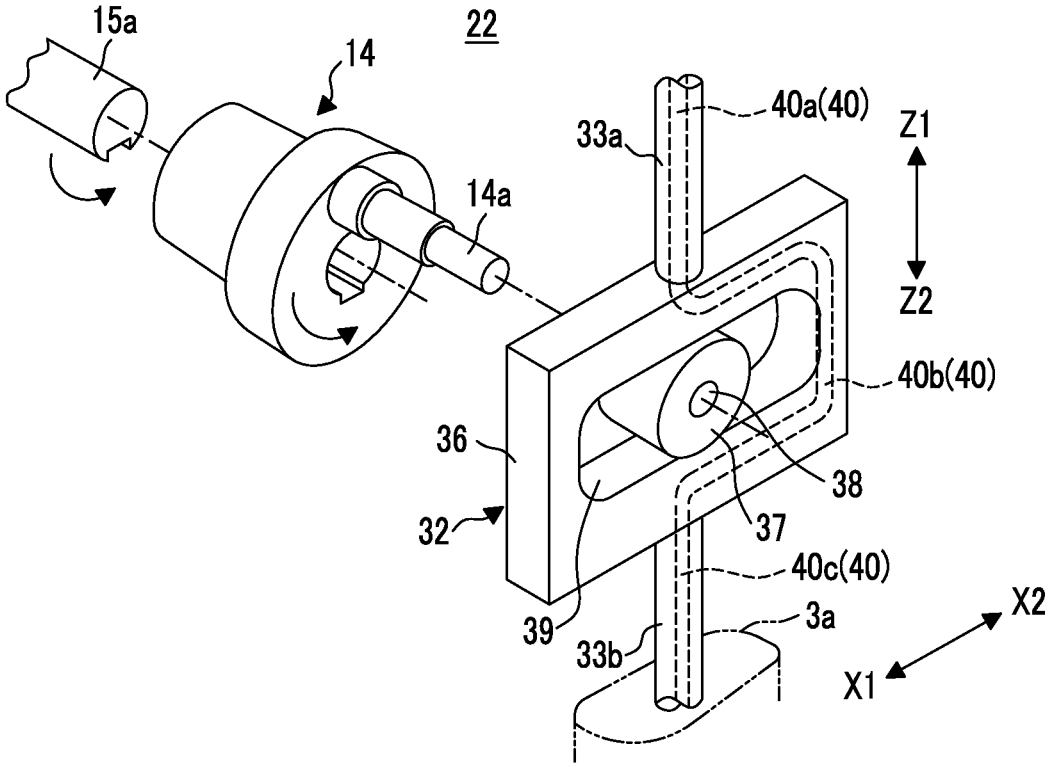
FIG. 2 is a view in which a scotch yoke mechanism is enlarged.

In FIG. 2, the scotch yoke mechanism 22 is shown to be enlarged. The scotch yoke mechanism 22 includes a crank 14, a scotch yoke 32, or the like. For example, the scotch yoke mechanism 22 can be driven by a drive unit such as a motor 15.

The crank 14 is fixed to a rotary shaft (hereinafter, referred to as a driving rotary shaft 15*a*) of the motor 15. The crank 14 is configured to include an eccentric pin 14*a* at a position eccentric from the mounting position of the driving rotary shaft 15*a*. Accordingly, if the crank 14 is mounted on the driving rotary shaft 15*a*, the driving rotary shaft 15*a* and the eccentric pin 14*a* are eccentric to each other.

The scotch yoke 32 includes drive shafts 33*a* and 33*b*, a yoke plate 36, a roller bearing 37, a scotch yoke pipe 40, or the like. A scotch yoke accommodation space, in which the scotch yoke 32 is accommodated in the housing 23, communicates with the intake port of the compressor 1 via the discharge pipe 1*b*. Accordingly, the scotch yoke accommodation space is always maintained in a low pressure.

The drive shaft 33*a* extends upward (Z1 direction) from the yoke plate 36. The drive shaft 33*a* is rotatably supported by a slide bearing 17*a* which is provided in the housing 23. Therefore, the drive shaft 33*a* is configured to be movable in up and down directions (the directions of arrows Z1 and Z2 in the drawings) in the drawings.

In addition, in the present embodiment, in order to clearly describe a positional relationship of components of the cryogenic refrigerator, a term such as an "axial direction" may be used. The axial direction indicates the direction in which the drive shaft 33*a* extends, and also coincides with the direction in which the displacer moves. For convenience, a position relatively close to the expansion space or the cooling stage with respect to the axial direction may be referred to as a "lower side", and a position relatively far from the expansion space or the cooling stage may be referred to as an "upper side". That is, the position relatively far from the low temperature side end may be referred to as the "upper side", and the position relatively close to the low temperature side end may be referred to as the "lower side". Moreover, the positional expressions are not related to the disposition when GM refrigerator is mounted. For example, GM refrigerator may be mounted so that the expansion space is positioned upward in a vertical direction.

Moreover, a predetermined range of an upper end of the drive shaft 33*a* is inserted into the communication space 41. A slipper seal 35 is provided between the communication space 41 and the slide bearing 17*a*. The slipper seal 35 airtightly partitions the communication space 41 and an inner space (scotch yoke accommodation space) of the housing 23.

The drive shaft 33*b* extends downward (Z2 direction) from the yoke plate 36. The drive shaft 33*b* is rotatably supported by a slide bearing 17*b* which is provided in the housing 23. Therefore, the drive shaft 33*b* is also configured to be movable in up and down directions (the directions of arrows Z1 and Z2 in the drawings) in the drawings.

The drive shafts 33*a* and 33*b* are rotatably supported by the slide bearings 17*a* and 17*b*, respectively, and thus, the scotch yoke 32 is configured to be movable in up and down directions (the directions of arrows Z1 and Z2 in the drawings) in the housing 23.

An oblong window 39 is formed in the yoke plate 36. The oblong window 39 extends in directions (the directions of arrows X1 and X2 in FIG. 2) intersecting the directions in which the drive shafts 33*a* and 33*b* extend, for example, orthogonal to the extending directions of the drive shafts.

The roller bearing 37 is disposed in the oblong window 39. The roller bearing 37 is configured to roll in the oblong window 39. Moreover, an engagement hole 38 engaging with the eccentric pin 14*a* is formed at a center position of the roller bearing 37.

When the motor 15 drives and the driving rotary shaft 15*a* rotates, the eccentric pin 14*a* is rotated so as to draw an arc. Accordingly, the scotch yoke 32 reciprocates in the directions of arrows Z1 and Z2 in the drawings. In this case, the roller bearing 37 reciprocates in the directions of arrows X1 and X2 in the drawings in the oblong window 39.

The first step displacer 3*a* is connected to the drive shaft 33*b* which is disposed below the scotch yoke 32. Accordingly, the scotch yoke 32 reciprocates in directions of arrows Z1 and Z2 in the drawings, and thus, the first step displacer 3*a* and the second step displacer 3*b* connected to the first step displacer reciprocate in the directions of arrows Z1 and Z2 in the first step cylinder 10*a* and the second step cylinder 10*b*.

Moreover, for convenience of the descriptions, the scotch yoke pipe 40 provided in the scotch yoke 32 will be described below.

Return to FIG. 1, a valve mechanism will be described. In the present embodiment, an example in which a rotary valve RV is used as the valve mechanism is described. However, for example, other valve mechanisms such as a spool valve may be also used.

The rotary valve RV switches the channels of the working gas. The rotary valve RV functions as a supply valve (V1) which introduces the working gas discharged from the discharge port of the gas compressor 1 to the first step displacer 3*a*, and functions as a discharging valve (V2) which introduces the working gas from the first step displacer 3*a* to the intake port of the gas compressor 1.

The rotary valve RV includes a stator valve 8 and the rotor valve 9.

Due to a pin 19, the stator valve 8 is fixed so as not to be rotated with respect to the housing 23. In contrast, the rotor valve 9 is rotatably supported in the housing 23.

The eccentric pin 14*a* of the scotch yoke mechanism 22 is connected to the rotor valve 9. The eccentric pin 14*a* is rotated, and thus, the rotor valve 9 is rotated with respect to the stator valve 8.

One end of the gas channel 21 is connected to the communication space 41. Moreover, the other end of the gas channel 21 is connected to the rotary valve RV, and thus, is selectively connected to the discharge port of the gas compressor 1 or the intake port of the gas compressor 1. The gas channel 21 may be formed in the housing 23. However, the gas channel 21 may have other configurations. For example, the gas channel 21 is configured of pipes and may be configured to connect the rotary valve RV and the communication space 41 outside the housing 23.

If the supply valve V1 is opened (if the discharge port of the gas compressor 1 and the communication space 41 communicate with each other) according to the rotation of the rotor valve 9, a high pressure working gas is supplied from the gas compressor 1 to the communication space 41 via the supply pipe 1*a*, the rotary valve RV, and the gas channel 21.

In contrast, if the discharge valve V2 is opened according to the rotation of the rotor valve 9 (if the gas channel 21 and the intake port of the gas compressor 1 communicate with each other) after cooling is generated, the working gas, which reaches a low pressure to generate the cooling, flows into the gas channel 21 and the rotary valve RV from the communication space 41. In addition, the rotary valve RV communicates with the discharge pipe 1*b*, and the working gas flows into the intake port of the gas compressor 1 via the discharge pipe 1*b*.

The supply operation of the working gas from the supply pipe 1*a* to the communication space 41 and the discharge operation of the working gas from the communication space 41 to the discharge pipe 1*b* are repeatedly performed by continuously rotating the rotor valve 9 by the motor 15.

Timing of the supply and the discharge of the working gas and timing of the reciprocal drives of the displacers 3*a* and 3*b* synchronize with the rotation of the crank 14. Accordingly, by appropriately adjusting phases of the supply and the discharge of the working gas and phases of the reciprocal drives of the displacers 3*a* and 3*b*, the working gas in the first step and the second step expansion chambers 11*a* and 11*b* can be expanded. Therefore, the cooling can be generated in the expansion chambers 11*a* and 11*b*.

Next, the pipe, through which the working gas flows between the first step displacer 3*a* and the housing 23, will be described.

In the present embodiment, an example is described in which the scotch yoke pipe 40 is used as the pipe through which the working gas flows between the first step displacer 3*a* and the housing 23. As shown in FIGS. 1 and 2, the scotch yoke pipe 40 is provided in the scotch yoke mechanism 22.

The scotch yoke pipe 40 is a pipe through which the working gas flows between the first step displacer 3*a* and the housing 23. More specifically, the scotch yoke pipe 40 which is a pipe through which the communication space 41 formed in the housing 23 and the working gas channel 4*a* formed in the first step displacer 3*a* communicate with each other.

The scotch yoke pipe 40 includes an upper pipe 40*a*, a bypass pipe 40*b*, and a lower pipe 40*c*. The pipes 40*a*, 40*b*, and 40*c* are configured to be integrally connected to each other.

The upper pipe 40*a* is formed to vertically penetrate the drive shaft 33*a*. The upper pipe 40*a* is formed to penetrate in up and down directions (directions of arrows Z1 and Z2) along a center axis of the drive shaft 33*a*.

The upper end of the upper pipe 40*a* is opened to the upper end of the drive shaft 33*a*. Moreover, as described above, the predetermined range of the upper end of the drive shaft 33*a* is inserted into the communication space 41. Accordingly, the upper end of the upper pipe 40*a* is configured to communicate with the communication space 41.

The bypass pipe 40*b* is formed in the yoke plate 36 of the scotch yoke 32. The oblong window 39 is formed in the yoke plate 36. The bypass pipe 40*b* is formed to bypass the oblong window 39 (refer to FIG. 2).

The upper end of the bypass pipe 40*b* is connected to the lower end of the upper pipe 40*a* formed in the drive shaft 33*a*. Moreover, the lower end of the bypass pipe 40*b* is connected to the upper end of the lower pipe 40*c* which is formed in the drive shaft 33*b* described below.

The lower pipe 40*c* is formed to vertically penetrate the drive shaft 33*b* which is provided below the yoke plate 36. The lower pipe 40*c* is formed to penetrate in up and down directions (directions of arrows Z1 and Z2) along a center axis of the drive shaft 33*b*.

The lower end of the upper pipe 40*a* is connected to the upper end of the bypass pipe 40*b*. Moreover, the lower end of the bypass pipe 40*b* is connected to the upper end of the lower pipe 40*c*. Accordingly, the housing 23 (communication space 41) and the first step displacer 3*a* are connected to each other via the scotch yoke pipe 40 including the upper pipe 40*a*, the bypass pipe 40*b*, and the lower pipe 40*c*.

In addition, in the embodiment, the configuration example in which the bypass pipe 40*b* is formed inside the yoke plate 36 is described. However, the bypass pipe 40*b* may be provided to be disposed on the outer circumference of the yoke plate 36.

That is, the bypass pipe 40*b* is configured to have a pipe separated from the drive shaft 33, the separated bypass pipe 40*b* may be mounted to surround the outer circumference of the yoke plate 36, and can move in up and down directions to integrate with the scotch yoke 32.

In GM refrigerator according to the present embodiment, if the high pressure working gas is supplied from the gas compressor 1 to the communication space 41 (housing 23) via the rotary valve RV or the like, the high pressure working gas flows in the scotch yoke pipe 40 from the upper end of the upper pipe 40*a*.

The high pressure working gas flowing in the scotch yoke pipe 40 sequentially passes the upper pipe 40*a*, the bypass pipe 40*b*, and the lower pipe 40*c*, and flows inside the first step displacer 3*a* via the gas channel L1.

The scotch yoke pipe 40 is connected to the communication space 41 and the first step displacer 3*a* without passing through the upper chamber 13. That is, the upper chamber 13 is isolated from the channel for introducing the working gas to the displacer. Accordingly, the high pressure working gas supplied from the gas compressor 1 does not flow into the upper chamber 13, and flows from the housing 23 into the first step displacer 3*a*.

Meanwhile, a low pressure working gas expanded in the expansion chambers 11*a* and 11*b* flows into the gas channel L1 through the gas channels L2 to L4, working gas channels 4*a* and 4*b*, or the like. As described above, the gas channel L1 is connected to the lower pipe 40*c*. Accordingly, the low pressure working gas flows into the scotch yoke pipe 40.

The low pressure working gas flowing into the scotch yoke pipe 40 sequentially passes the lower pipe 40*c*, the bypass pipe 40*b*, and the upper pipe 40*a*, and reaches the discharge pipe 1*b* via the gas channel 21.

As described above, the scotch yoke pipe 40 is connected to the communication space 41 and the first step displacer 3*a* without passing through the upper chamber 13. That is, the scotch yoke pipe 40 is connected to the communication space 41 and the first step displacer 3*a* by the pipe which is isolated from the upper chamber 13. Accordingly, even when the low pressure working gas recirculates to the gas compressor 1, the low pressure working gas does not flow into the upper chamber 13 and recirculates to the gas compressor 1 from the housing 23.

In this way, in the GM refrigerator according to the present embodiment, the housing 23 (communication space 41) and the first step displacer 3*a* are connected by the scotch yoke pipe 40. Moreover, the scotch yoke pipe 40 is configured to bypass the upper chamber 13. That is, the upper chamber 13 does not become the channel of the working gas. Moreover, in the upper chamber 13, leakage of the working gas may occur in a gap between the displacer 3*a* and the cylinder 10*a*, a gap between the drive shaft and the housing, or the like. However, the upper chamber 13 communicates with the scotch yoke accommodation space which is always maintained at a low pressure, and thus, a pressure change of the upper chamber 13 is decreased.

Therefore, the displacers 3*a* and 3*b* is reciprocated up and down by the scotch yoke mechanism 22, and thus, even when capacity of the upper chamber 13 is changed, the pressure change in the upper chamber 13 is decreased, and occurrence of compression heat in the working gas can be suppressed. Accordingly, heat loss of the working gas can be decreased.

Moreover, since the upper chamber 13 having a large capacity does not exist in the channel through which the working gas flows, it is possible to decrease power consumption of the motor which drives the gas compressor 1. Accordingly, a cooling efficiency (COP: obtained by (refrigeration capacity)÷(power consumption)) of GM refrigerator can be increased.

Moreover, the working gas directly flows into and flows from the working gas channel 4*a* in the first step displacer 3*a* from the scotch yoke pipe 40.

Next, another embodiment of the present invention will be described with reference to FIGS. 3 to 6.

Moreover, in FIGS. 3 to 6, the same reference numerals are attached to configurations corresponding to the configurations shown in FIGS. 1 and 2 used in the previous descriptions, and descriptions thereof are omitted.

Figure 3:
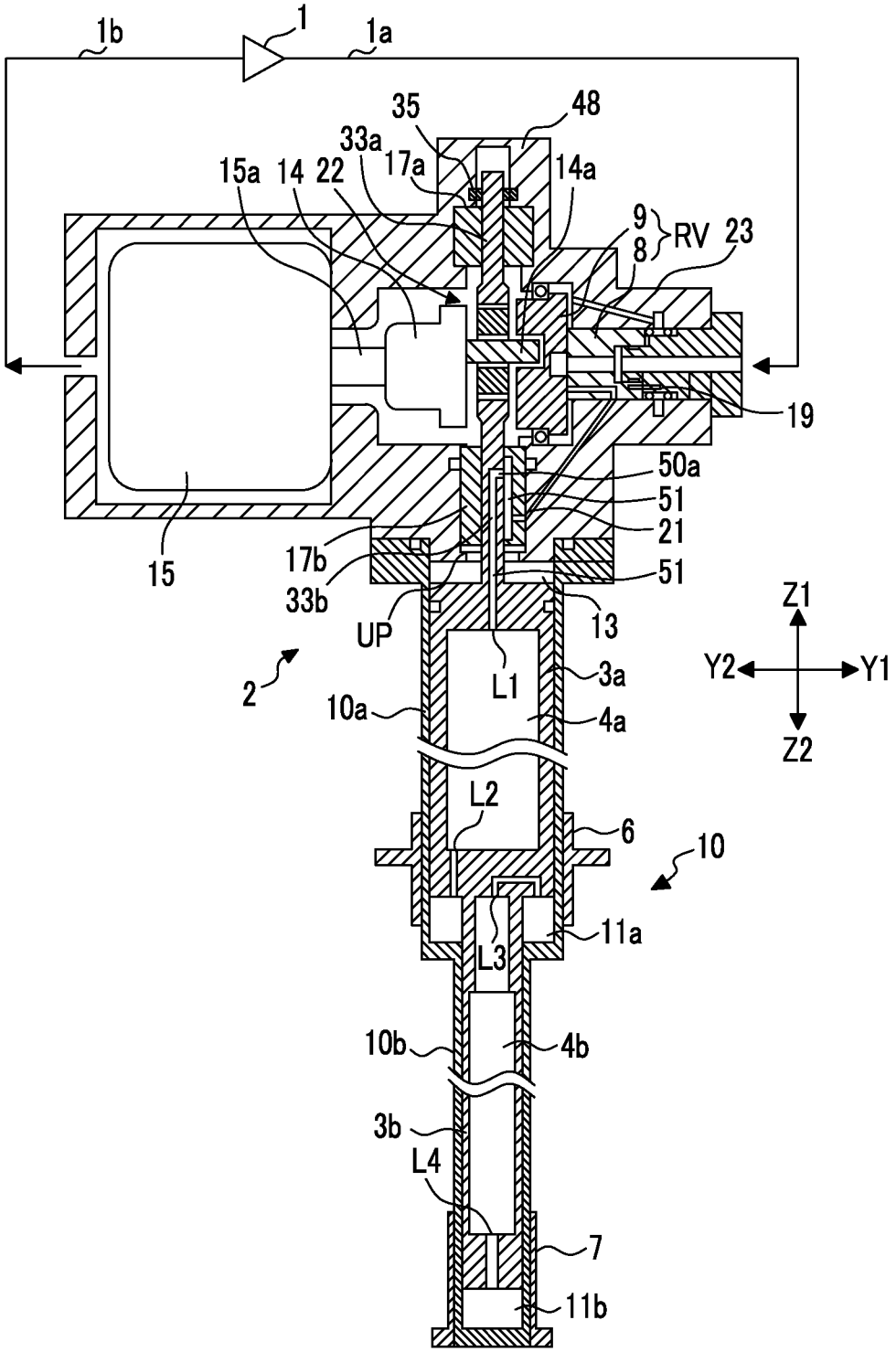
FIG. 3 is a cross-sectional view of GM refrigerator according to another embodiment of the present invention.

In GM refrigerator according to the embodiment shown in FIG. 3, a drive shaft pipe 50 is formed only in the drive shaft 33*b* of the scotch yoke. The lower end of the drive shaft pipe 50 is connected to the gas channel L1 which is formed on the high temperature side end of the first step displacer 3*a*.

Moreover, the upper end of the drive shaft pipe 50 is connected to a connection hole 50*a*. The drive shaft pipe 50 extends in the movement directions (Z1 and Z2 directions) of the first step displacer 3*a*, and in contrast, the connection hole 50*a* is formed in the directions (Y1 and Y2 directions) intersecting the movement directions. One end of the connection hole 50*a* is connected to the upper end of the drive shaft pipe 50, and the other end is opened to the outer circumference of the drive shaft 33*b*.

A long hole 51 is formed on the slide bearing 17*b* which is provided in the housing 23. The long hole 51 is formed at a position facing the connection hole 50*a* on the inner circumference surface of the slide bearing 17*b* confronting the drive shaft 33*b*.

The long hole 51 is formed to extend long in the movement directions (Z1 and Z2 directions) of the drive shaft 33*b*. A length of the long hole 51 is set to be longer than a distance in which the displacers 3*a* and 3*b* move up and down. Accordingly, the connection hole 50*a* and the long hole 51 are always connected to each other regardless of the vertical movements of the displacers 3*a* and 3*b*.

In addition, the long hole 51 is connected to the gas channel 21 which is formed in the housing 23. Accordingly, the long hole 51 is connected to the gas compressor 1 via the gas channel 21, the rotary valve RV, and pipes 1*a* and 1*b*. That is, the long hole 51 functions as the communication space.

In addition, as a material of the slide bearing 17*b* used in the present embodiment, a material which also functions as a seal material is selected. Accordingly, an airtight state is maintained between the slide bearing 17*b* and the drive shaft 33*b*. Therefore, leakage of the working gas is decreased at the connection position between the connection hole 50*a* and the long hole 51. Moreover, a seal member may be provided, which seals between the long hole 51 and the scotch yoke accommodation space or between the long hole 51 and the upper chamber 13. As the seal member, a slipper seal or the like is preferable.

In GM refrigerator according to the present embodiment, the first step displacer 3*a* and the housing 23 (long hole 51) are connected by the drive shaft pipe 50 without passing through the upper chamber 13. Accordingly, even when the displacers 3*a* and 3*b* reciprocate, occurrence of compression heat in the upper chamber 13 is suppressed, the heat loss of the working gas can be decreased, and the coefficient of performance (COP) can be increased. In addition, in the present embodiment, the example in which the scotch yoke mechanism is used as the drive mechanism is described. However, certain embodiments of the present invention are not limited thereto. The drive shaft may be driven by a cam mechanism different from the scotch yoke mechanism, or may be driven by a linear motor.

Figure 4:
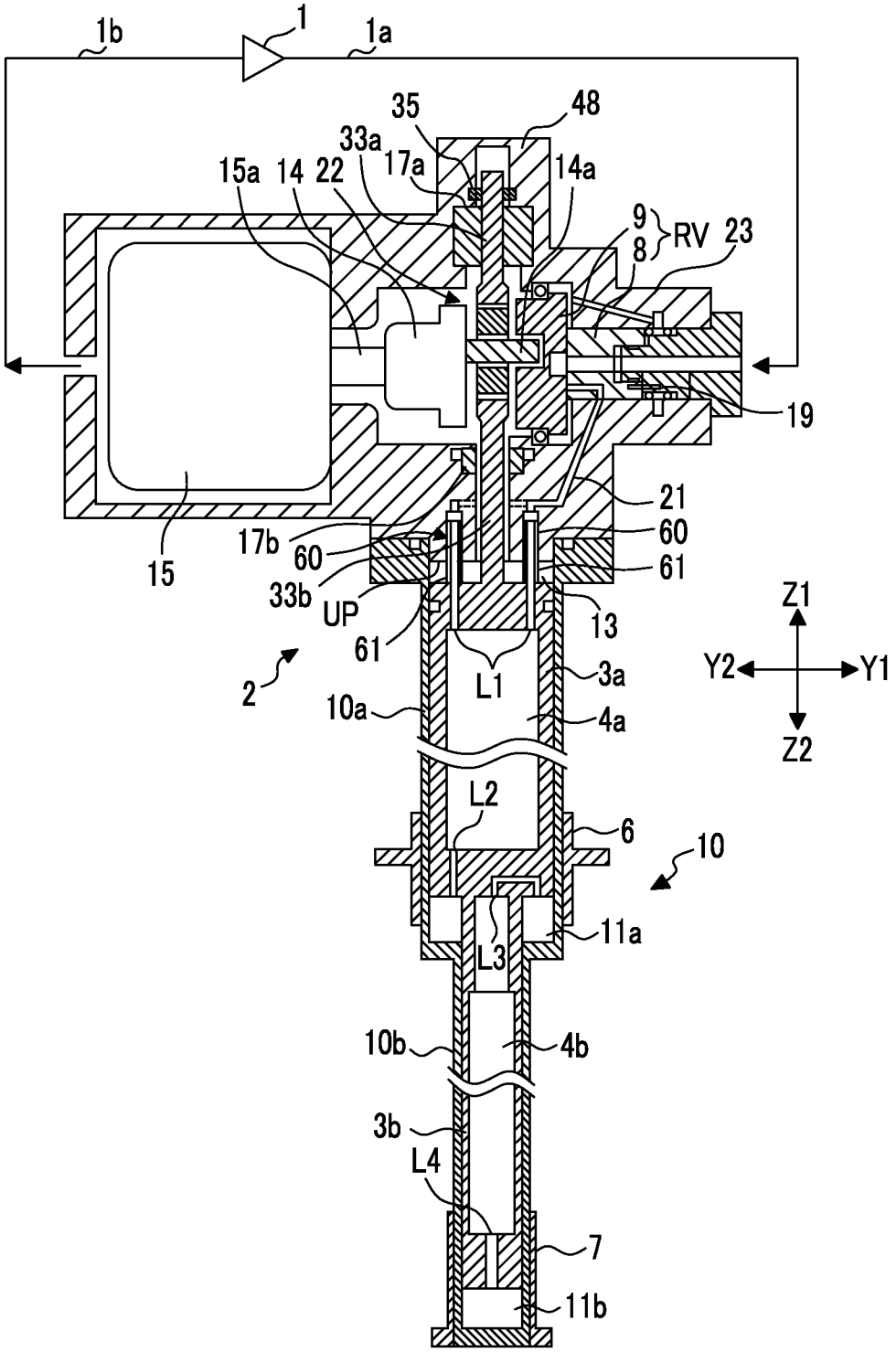
FIG. 4 is a cross-sectional view of GM refrigerator according to still another embodiment of the present invention.
Figure 5:
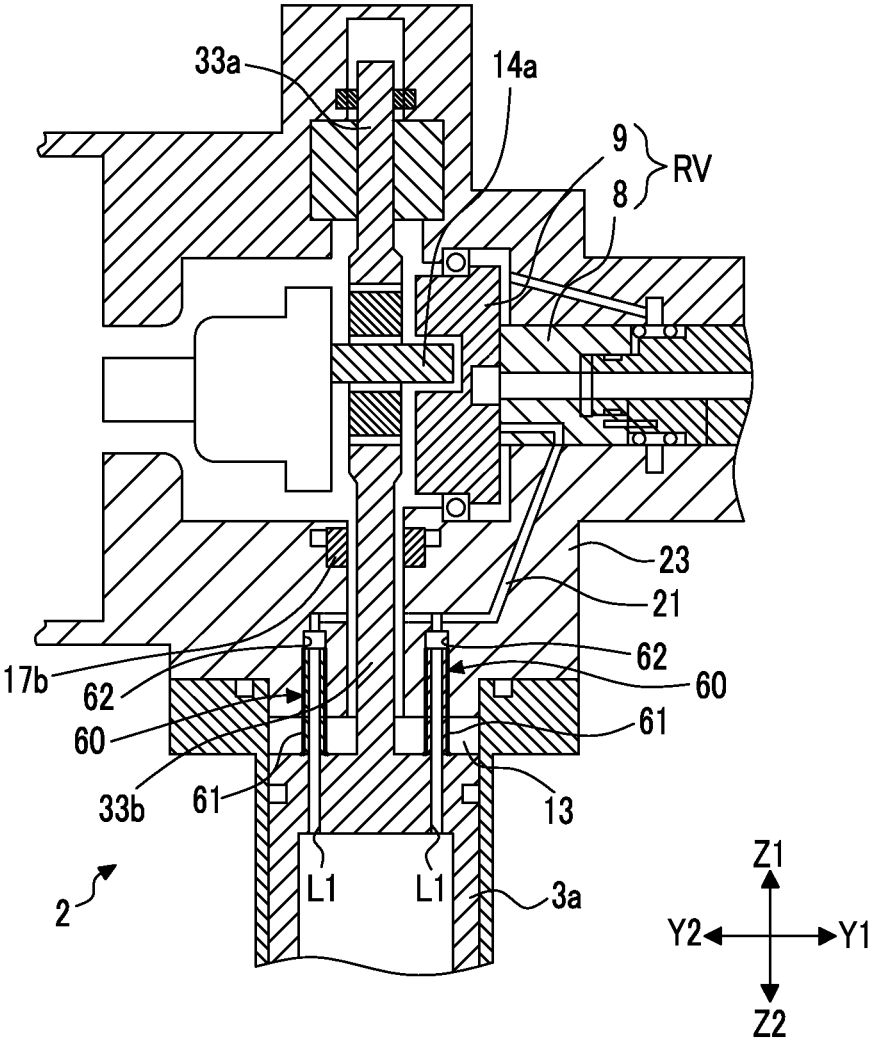
FIG. 5 is a cross-sectional view in which the vicinity of a connection mechanism shown in FIG. 4 is enlarged.

FIGS. 4 and 5 show GM refrigerator according to still another embodiment.

In GM refrigerator according to the present embodiment, the housing 23 and the first step displacer 3*a* are connected to each other using a connection mechanism 60. The connection mechanism 60 includes an erected pipe 61, an accommodation portion 62, or the like.

The erected pipe 61 is a linear pipe, and is erected upward from the upper surface of the high temperature side end of the first step displacer 3*a*. For example, the erected pipe 61 can be fixed to the first step displacer 3*a* by a joining method such as welding. However, the fixing method is not limited thereto, and may use other fixing methods such as press fitting.

In addition, in the present embodiment, a plurality (for example four) of the gas channels L1 are formed on the high temperature end side of the first step displacer 3*a*. A plurality of the erected pipes 61 are provided to correspond to the gas channels L1. However, a single gas channel L1 and a single erected pipe 61 may be provided according to a flow rate of the working gas.

Accommodation portions 62 are formed at positions facing the erected pipes 61 of the housing 23. Each of the accommodation portions 62 is a concave space which is formed in the housing 23. The gas channel 21 is connected to the accommodation portions 62. The end of the gas channel 21 is branched according to the number of the accommodation portions 62. Each branched pipe is connected to a bottom portion of each accommodation portion 62.

Each erected pipe 61 is inserted into the corresponding accommodation portion 62. Since the erected pipes 61 are fixed to the first step displacer 3*a*, the erected pipes move in up and down directions (Z1 and Z2 directions) according to the movement of the first step displacer 3*a*. The connection mechanisms 60 are configured so that the erected pipes 61 can move in the accommodation portions 62.

Moreover, even when the erected pipes 61 move in the accommodation portions 62, airtight states are maintained between the erected pipes 61 and the accommodation portions 62. In order to maintain the airtight states, for example, seal materials or the like may be provided between the erected pipes 61 and the accommodation portions 62. For example, as the seal material, a slipper seal may be used.

In addition, a depth of the erected pipe 61 inserted into the accommodation portion 62 is set to a length in which a connection state between the erected pipe 61 and the accommodation portion 62 can be maintained so that the erected pipe 61 is not separated from the accommodation portion 62 even when the first step displacer 3*a* moves.

In GM refrigerator according to the present embodiment, the first step displacer 3*a* and the housing 23 are connected by the connection mechanisms 60 (erected pipes 61 and accommodation portions 62) without passing through the upper chamber 13. Accordingly, also in GM refrigerator according to the present embodiment, even when the displacers 3*a* and 3*b* reciprocate, occurrence of compression heat in the upper chamber 13 is suppressed, the heat loss of the working gas can be decreased, and the coefficient of performance (COP) can be increased.

Moreover, in the embodiment, the accommodation portions 62 are provided in the housing 23, and the erected pipes 61 are provided in the first step displacer 3*a*. However, the erected pipes 61 may be provided in the housing 23, and the accommodation portions 62 may be provided in the first step displacer 3*a*.

Figure 6:
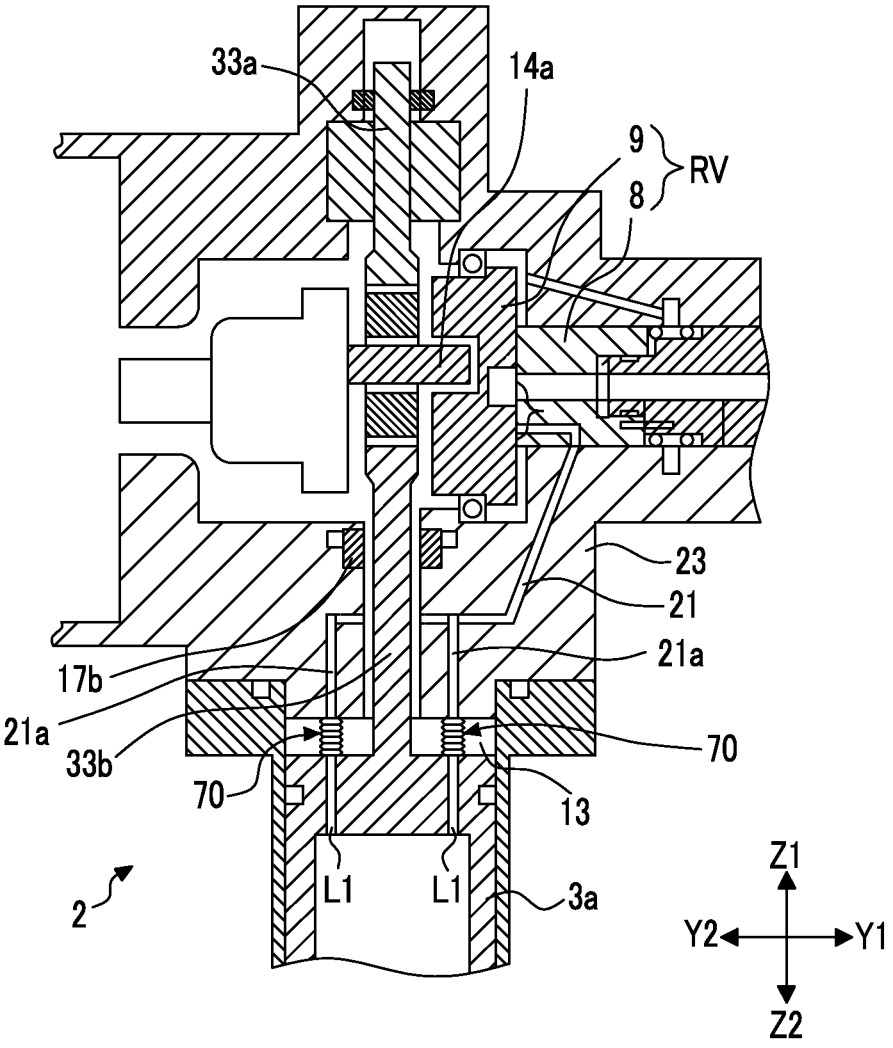
FIG. 6 is a cross-sectional view in which a main portion of GM refrigerator according to still another embodiment of the present invention is enlarged.

FIG. 6 shows GM refrigerator according to still another embodiment.

In GM refrigerator according to the present embodiment, the housing 23 and the first step displacer 3*a* are connected using flexible pipes 70.

A plurality of gas channels L1 are formed on the high temperature side end of the first step displacer 3*a*. Moreover, a branching channel 21*a* branched from the gas channel 21 is formed at a position facing each gas channel L1 of the housing 23. The flexible pipes 70 are provided to connect the branching channels 21*a* and the gas channels L1.

Positions at which the gas channels L1 and the flexible pipes 70 are connected to each other, and positions at which the branching channels 21*a* and the flexible pipes 70 are connected move according to the first step displacer 3*a*. Even when the first step displacer 3*a* moves up and down, the flexible pipes 70 are flexibly deformed, and thus, the connections between the branching channels 21*a* and the gas channels L1 are maintained.

A material and a configuration of the flexible pipe 70 are not particularly limited if the flexible pipe is flexible according to the movement of the first step displacer 3*a* and can maintain airtightness. For example, as the flexible pipe 70, a tube configured of a resin having flexibility and durability or a pipe having a metallic bellows structure may be used. Moreover, the flexible pipe 70 can have elasticity.

Also in GM refrigerator according to the present embodiment, the first step displacer 3*a* and the housing 23 are connected by the flexible pipes 70 without passing through the upper chamber 13. Accordingly, also in GM refrigerator according to the present embodiment, even when the displacers 3*a* and 3*b* reciprocate, occurrence of compression heat in the upper chamber 13 is suppressed, the heat loss of the working gas can be decreased, and the coefficient of performance (COP) can be increased.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

a compressor which compresses a working gas;

a housing which includes a space which the working gas compressed by the compressor flows into and flows from;

a valve configured to switch flowing-in and flowing-out of the compressed working gas;

a gas channel that communicates with the valve and the space;

a cylinder of which a first end is connected to the housing and which includes an expansion space at a second end, which is opposite to the first end;

a displacer which permits flowing of the working gas into and from the expansion space via a working gas channel provided in an inner portion of the displacer while reciprocating in an inner portion of the cylinder; and a drive shaft that extends in an axial direction, the drive shaft comprises a lower end connected to an upper end plate of the displacer at a center of the upper end plate in a radial direction perpendicular to the axial direction and an upper end facing an upper end of the housing, the drive shaft is configured to drive the displacer, wherein the working gas is configured to flow through a pipe which communicates with the space and the working gas channel, the pipe comprises one of a plurality of linear pipes located outside of the drive shaft in the radial direction, the one of the plurality of linear pipes protruding from the upper end plate of the displacer, the space is a concave portion depressed from a lower end surface of the housing, and an upper end of the one of the plurality of linear pipes is normally accommodated in the concave portion and a lower end of the one of the plurality of linear pipes is fixed to the upper end plate of the displacer.

2. A cryogenic refrigerator comprising:

a compressor which compresses a working gas;

a housing which includes a space which the working gas compressed by the compressor flows into and flows from;

a valve configured to switch flowing-in and flowing-out of the compressed working gas;

a gas channel that communicates with the valve and the space;

a cylinder of which a first end is connected to the housing and which includes an expansion space at a second end, which is opposite to the first end;

a displacer that permits flowing of the working gas into and from the expansion space via a working gas channel provided in an inner portion of the displacer while reciprocating in an inner portion of the cylinder; and a drive shaft that comprises a lower end connected to an upper end of the displacer and an upper end facing an upper end of the housing and drives the displacer, wherein the working gas is configured to flow through a pipe which communicates with the space and the working gas channel, the pipe is integrally provided to the drive shaft, an upper end of the pipe opens to the space at the upper end of the drive shaft, and a lower end of the pipe opens to the working gas channel at the lower end of the drive shaft, the drive shaft includes a yoke plate having an oblong window, an upper drive shaft extending upward from the yoke plate and a lower drive shaft extending downward from the yoke plate, and the pipe includes an upper pipe which penetrates the upper drive shaft, a bypass pipe which bypasses the oblong window, and a lower pipe which penetrates the lower drive shaft.

* * * * *